US008657639B2

(12) United States Patent
McIlwain

(10) Patent No.: US 8,657,639 B2
(45) Date of Patent: Feb. 25, 2014

(54) WATER SPORTING DEVICE HAVING RETRACTABLE FINS

(76) Inventor: Douglas Graham McIlwain, Savannah, GA (US)

( * ) Notice: Subject to any disclaimer, the term of this patent is extended or adjusted under 35 U.S.C. 154(b) by 165 days.

(21) Appl. No.: 13/199,161

(22) Filed: Aug. 22, 2011

(65) Prior Publication Data

US 2013/0052895 A1 Feb. 28, 2013

(51) Int. Cl.
*B63B 35/85* (2006.01)

(52) U.S. Cl.
USPC ..... 441/79

(58) Field of Classification Search
USPC ..... 441/79, 74; 114/140, 132, 141
See application file for complete search history.

(56) References Cited

U.S. PATENT DOCUMENTS

| | | | |
|---|---|---|---|
| 3,066,327 | A | 12/1962 | Durfey |
| 3,082,444 | A | 3/1963 | Estes |
| 3,087,173 | A | 4/1963 | Meyer |
| 3,516,100 | A | 6/1970 | Ellis |
| 4,637,313 | A | 1/1987 | Henderson et al. |
| 4,733,496 | A | 3/1988 | Wallner |
| 4,804,347 | A | 2/1989 | Ross |
| 4,805,546 | A | 2/1989 | Geller et al. |
| 4,883,436 | A | 11/1989 | Oakland |
| 5,129,344 | A | 7/1992 | Ono et al. |
| 5,152,705 | A | 10/1992 | Rock |
| 5,356,324 | A | 10/1994 | Cunningham |
| 6,068,531 | A | 5/2000 | Patterson |
| 6,254,446 | B1 | 7/2001 | Thigpen |
| 6,896,570 | B1 | 5/2005 | O'Keefe et al. |
| 2010/0233921 | A1 | 9/2010 | Kumano et al. |
| 2010/0323568 | A1 | 12/2010 | Chambers |

FOREIGN PATENT DOCUMENTS

| | | | |
|---|---|---|---|
| FR | 2 633 893 | A1 | 12/1990 |
| FR | 2 703 022 | A1 | 9/1994 |
| WO | WO 88/09744 | A1 | 12/1988 |

*Primary Examiner* — Edwin Swinehart
(74) *Attorney, Agent, or Firm* — Mark L. Davis

(57) ABSTRACT

A water sport flotation device having an upper surface directed toward a user, an opposing bottom surface directed toward the water, and a pair of stabilizing fins, each fin having a top portion and a bottom edge. The flotation device further including a plurality of longitudinally disposed through slots in the upper surface and bottom surface, each slot partially surrounding each fin, and a flexible, resilient biasing means attached to the top portion of each fin and affixed to the upper surface so that the biasing means applies a downward force on each fin. The biasing means allows the bottom edge of the fin to retract through the slot and parallel to the bottom surface, if necessary, if the flotation device encounters an object in the water.

17 Claims, 6 Drawing Sheets

WATER SPORTING DEVICE HAVING RETRACTABLE FINS

FIELD OF THE INVENTION

The present invention relates to water sports and particularly to water sports utilizing a floatation device having at least one substantially planar surface which incorporates at least one stabilizing fin. More particularly, the present invention is related to water boards having at least one retractable fin.

BACKGROUND OF THE INVENTION

Water sports and particularly water sports that utilize a floatation device are well known. Non-limiting examples of such sports include surfing, water-skiing, kneeboarding or waterboarding, and a recent popular water sport is wakeboarding.

Surfing is an old water sport and perhaps is one of the most pervasive water sports available in coastal regions of countries throughout the world. Surfing may be pursued in virtually any coastal or beach area in which the adjacent body of water provides the periodic on-shore wave pattern having amplitude to be enjoyed by surfers. Basically, the ocean-to-shore movement of periodically spaced waves typical of ocean coastal areas assumes a pattern of widely spaced rolling swells which provide a moving water surge having a downwardly angled shoreward slope which progresses toward the shore and which under many conditions tends to form a washover or curl along its upper crown or edge. In such areas where waves are sufficiently sized to be enjoyable, surfers can be seen waiting off-shore usually assuming prone or sitting positions upon their elongated buoyant surfboards. The basic object of the surfing activity is to observe an approaching wave and thereafter, in a properly timed activity to the waves, approach, paddle or otherwise maneuver the surfboard onto the shoreward slope of the wave in an activity generally referred to as "catching the wave". The maneuvering of the surfboard onto the wave slope is usually achieved by the surfer in an a prone facedown position upon the board. However, once the board has been maneuvered to the shoreward slope and is traveling shorewardly with the wave, surfers generally prefer to stand up upon the board and by skillful manipulation of the board and shifting of their body weight both front to back and side to side maneuver the surfboard along the traveling wave.

The overall or general construction of surfboards has not been significantly changed through the years. All generally provide a planar buoyant board usually tapered from a maximum width at its center to a relative pointed front and back end. One or more downwardly extending fins are provided on the rear undersurface of the surfboard to provide stability and control within the water. While early surfboards were formed of solid wood and were relatively long and heavy, more recent surfboards which are significantly smaller, use a lightweight rigid core of a thermoplastic, such as polyurethane or a polystyrene construction, which supports a fiberglass outer "skin". The result is an extremely buoyant surfboard which exhibits greater weight supporting capability and therefore may be fabricated much shorter and smaller than original heavy wooden boards. Such lightweight, high-buoyancy surfboards are also provided with one or more downwardly extending fins upon the undersurface of the rear portion of the surfboard. In either style of surfboard or in the many subtle variations that exist in each style, the downwardly extending rear fins are virtually a requirement to allow the surfer to maintain control and maneuverability due to the stabilizing action such fins provide by cutting or biting into the passing water stream.

Water-skiing is a sport that typically utilizes as a primary motive means a man-made device such as a motor boat. The skier may use one or two skis which are releasably attached to the user's feet via rubber bootings or straps. The bootings allow the user to slip from the ski when done, or in the case of a fall, allow the ski to become detached from the user without injuring the user. The front or nose of the ski is typically turned upward to prevent the ski from biting into the water and allowing the water, as the skier is pulled behind a boat, to channel under the ski, thus allowing the skier to "ride" or hydroplane on top of the water. Similar to the surfboard, a water ski typically includes at least one stabilizer fin.

Water boards are similar to water skis in that the water boarder is towed behind a powerful boat. However, the main difference in water boarding is that the water boarder kneels on the board. A strap is provided on the water board for the user to place over his/her thighs to keep the board in contact with the knees and shins of the user. It has been recognized that the stability of the water board can be greatly improved, under certain conditions, by incorporating two fins on the underside of the board. The fins provide control and lateral stability at high speeds. While this increase in stability is desirable for certain types of water boarding, there are other styles of water boarding wherein the fins are neither necessary nor desirable. One example of such a style would be jumping where the board and the user are towed across an inclined plane to gain altitude. Others would be spin-360's and side slides.

In wakeboarding, the rider secures the wakeboard to his or her feet through the use of bindings, which may include elastic straps or boots. One foot is secured in front of the other so that the rides typically stand sidewise on the board. The rider is then pulled behind a boat or other watercraft, in the same manner as in water-skiing, at such speeds that the wakeboard planes over the surface of the water. Early wakeboards had a shape very similar to surfboards, with a pointed front end and a more squared back end. Modern wakeboards have eliminated the pointed front end in favor of two symmetrical ends, which may be squared or have a more general curvature at the two opposing ends, similar to a snowboard. This allows the rider to reverse the orientation of the board with respect to the travel path while performing more complicated tricks during a ride.

In the aforementioned devices, a fin is typically added to the underside of the board to stabilize the board as it skims over the water. Due to the popularity of using the above types of boards for water sports, users have broadened their use to include doing tricks, such as spins, and jumping which typically utilizes a generally stationary ramp of a predetermined height. It is understood that a fixed fin, regardless of its size extending from the water contacting surface could be problematic in such events. Accordingly, moveable and/or retractable fins have been developed. For example, U.S. Pat. No. 5,152,705 discloses a multiple fin surfboard having a triad of elongated slots at both ends of the board. The slots are grouped close to the front and aft end of the surfboard and support a corresponding plurality of fins in a pivotal attachment. The fins each support transverse vanes which are acted upon by a water passage beneath the surfboard to alternatively retract the fins at one end of the surfboard and downwardly extend the fins at the opposite end of the surfboard. A problem with this arrangement is that the fin is not positively biased and it is possible that when the front of the board is not in contact with water, the frontal fins can descend, causing the board to become unmanageable if the front even momentarily contacts the water.

U.S. Pat. No. 3,066,327 discloses a retractable stabilizer for water skis which pivots about a pin passing through the stabilizer and its housing disposed at the aft-end of the ski and above the ski surface. A latch is provided to maintain the stabilizer in the retracted position.

U.S. Pat. No. 3,082,444 describes a water ski safety skeg or fin which is protected from damage from underwater debris and inclined ramps by its ability to automatically retract when contacting a ramp.

U.S. Pat. No. 3,087,173 shows a retractable fin positioned at the aft end of a ski. The fin is contained within a raised housing which protrudes above the plane of the surface where the user mounts or stands on the ski. The position of the fin is controlled by two leaf springs and an S-shaped track through which a slide pin travels.

U.S. Pat. No. 4,805,546 discloses a retractable stabilizer for a knee board. The fin is pivotally fastened to a casing which is designed to receive the entire fin when retracted. The casing is formed with a notch facing the user for selectively positioning the fin in an down position or in the retracted position. The position of the fin is operated by a lever connected to the fin.

The conventional wakeboard fin is a flat fin extending perpendicular to the underside of the board and has a hydrodynamic shape that tapers from the underside of the board toward both front and aft ends of the board. On some boards, a second fin, of the same shape as the first, is added at the opposed end of the board. The second fin may be smaller than the first, and is used to stabilize the board when the rider has reversed the board. However, conventional wakeboard fins are not entirely satisfactory since the fins are rigidly affixed to the water-facing surface. Accordingly, there is a need for a wakeboard having an improved fin that would make it easier for beginners to learn to wakeboard and for more advance riders to achieve better performance from their boards. Consequently, there is a need in the art for a means of improving the performance of a wakeboard.

SUMMARY OF THE INVENTION

Briefly, the present invention is a water sport floatation device, such as a surf board, ski, kneeboard, or a wakeboard having at least one substantially planar surface and which incorporates at least one retractable stabilizing fin. In a preferred embodiment, the water sport floatation device includes at least one pair of retractable stabilizing fins, and in a more preferred embodiment the water sport floatation device includes two pairs of retractable stabilizing fins, one pair each at opposing ends of the board. The water sport floatation device includes a through channel or slot that at least partially surrounds each fin and allows the retractable fin to extend below the bottom surface or plane of the water sport floatation device and still allow the fin to move upwardly when contacting a foreign object. The fin has a top portion that is rigidly affixed to a biasing means which applies a downwardly directed force to the fin. The biasing means is further rigidly attached to the upper surface or plane of the water sport floatation device in a manner that allows the biasing means to deflect sufficiently above the top plane and allow the bottom edge of the fin, if necessary, to deflect at least parallel to the bottom plane or surface of the board.

It is an object of the present invention to provide a water sport floatation device having at least one retractable fin that is positively biased in a downward direction.

It is another object of the presently invention to provide a wakeboard having a pair of retractable fins that are positively biased in a downward direction and independently move or retract parallel to the bottom of the wakeboard.

These and other objects and advantages of the present invention will become more apparent to those skilled in the art in view of the following description and the accompanying drawings wherein like parts and objects in the several views have similar reference numerals. It is to be understood that the inventive concept is not to be considered limited to the constructions disclosed herein but instead by the scope of the appended claims.

DETAILED DESCRIPTION OF THE INVENTION

Figure 1:
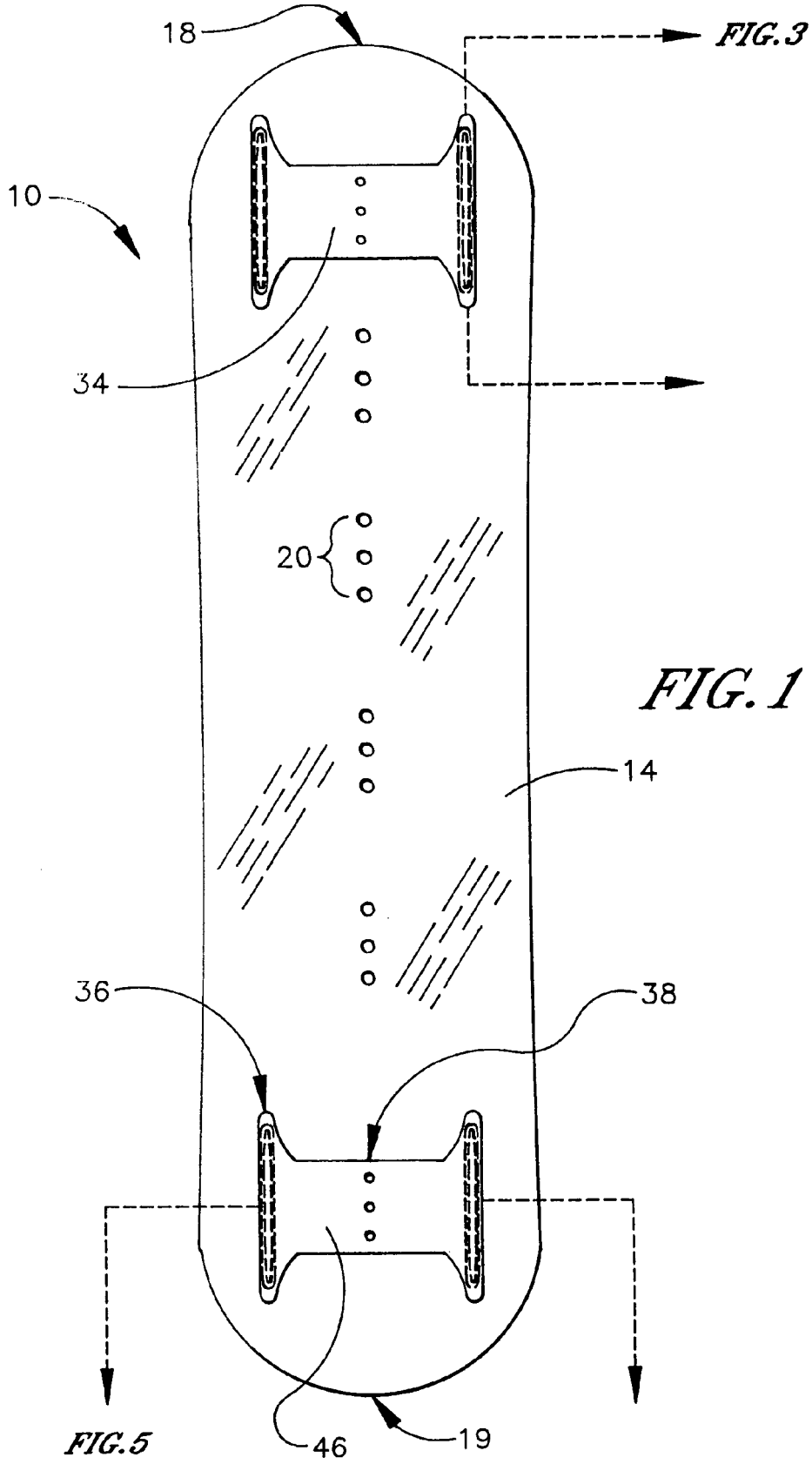
FIG. 1 is a top plan view of a water sport floatation device in accordance with the present invention, illustrated and described herein as a wakeboard, having a pair of retractable fins at the front and aft ends thereof.
Figure 2:
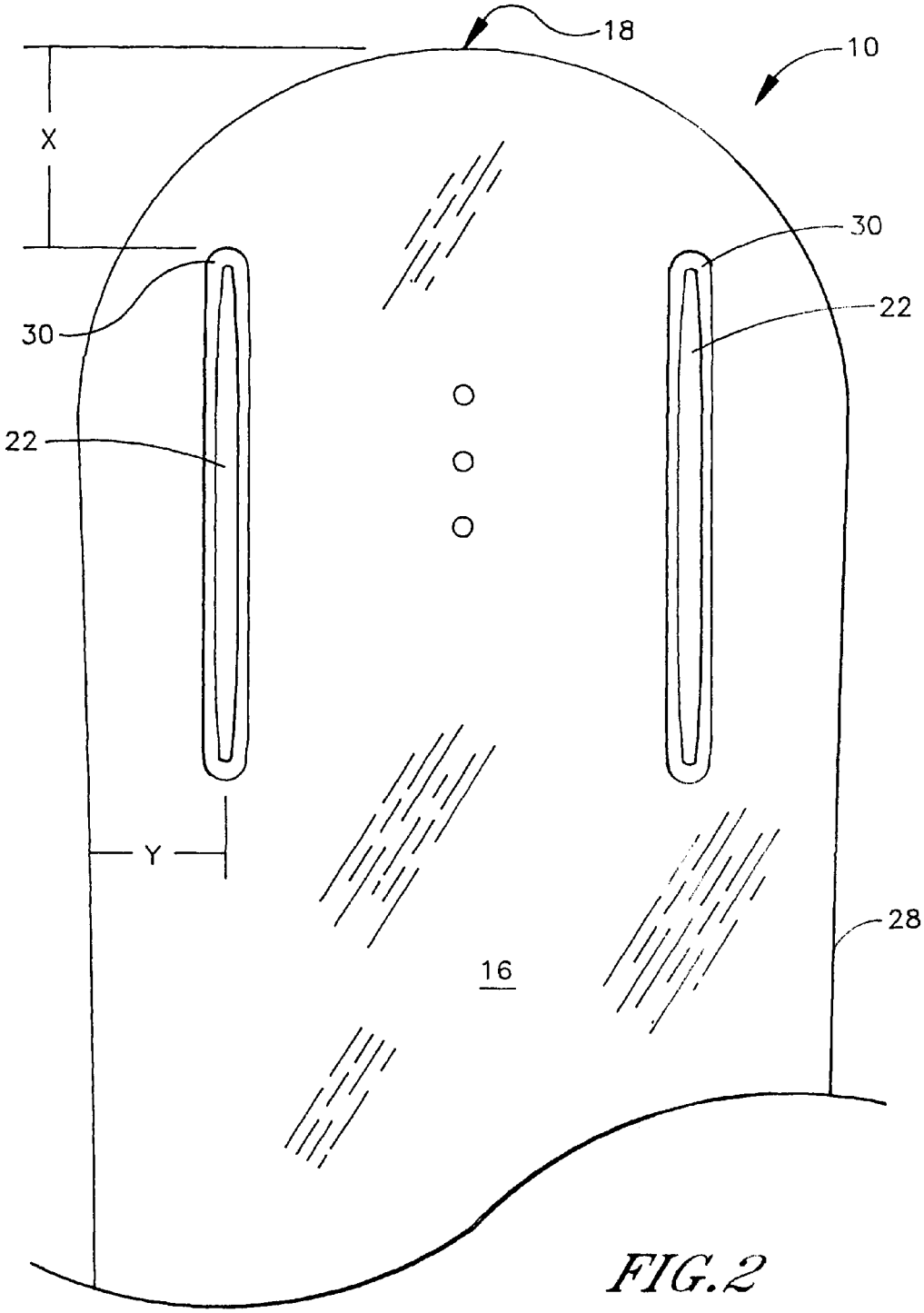
FIG. 2 is a partial bottom plan view of a water sport floatation device in accordance with the present invention, illustrated and described herein as a wakeboard, depicting a pair of retractable fins in greater detail for clarity of description.

Referring to FIGS. 1-5 wherein like parts and objects in the several views have similar reference numerals, the water sport floatation device in accordance with the present invention is illustrated and described herein as a wakeboard 10. However, the present invention is not limited to such a device. It is intended that such retractable fins could be adaptable to all manner of water sporting devices such as surf boards, skis, kneeboards, and the like. Turning to the drawings, wherein the present invention is described in greater detail, the wakeboard 10 generally is constructed of a laminated structure having a plurality of layers. A laminated construction affords the board to utilize lighter materials and retain sufficient strength to support a user while being pulled behind a motive device such as a motor boat or jet ski. The wakeboard 10 includes an upper surface or plane 14 disposed toward the user, an opposing bottom surface or plane 16 disposed toward the water, a first or front end 18 and a second or aft end 19. The upper surface 14 include a plurality of series of holes 20 for attaching one or more strap means or boots (not shown) to the board which removably engage the user's feet.

As used herein, the terms "top" "upper", and/or "upward" mean a surface, plane or direction toward or adjacent to the user during use. The terms "bottom", "underneath" and/or "lower" mean a surface, plane or direction toward or adjacent to the water.

The wakeboard 10 includes a plurality of fins 22 desirably having a first pair positioned toward first end 18 and a second pair positioned toward the second end 19. Since both ends 18 and 19 of the board 10 are substantially identical, only the front end 18 will hereinafter be described in greater detail. Moreover, since each fin 22 is substantially identical only one will hereinafter be described in detail, unless otherwise noted that the description is directed to a fin pair.

The fin 22 utilized in the wakeboard 10 is of a typical design having a top portion 24 and a bottom edge 26, an overall length, L, of from about 2 to about 10 inches (5 centimeters to about 25 centimeters) and a height from top 24 to the longest point on the bottom edge 26 of from about 0.5 inches to about 3 (1.25 centimeters to about 7.5 centimeters). The fin 22 generally has a hydrodynamic shape that tapers downwardly from the underside of the board 10 and thins as the fin 22 progresses toward the front and aft ends 18 and 19. The bottom edge 26 of the fin 22 may be curved and the depth of the fin diminishes or is reduced as seen from the front end 18 toward the middle of the board 10. This allows for proper hydrodynamic action.

The fin 22 is positioned on the board 10 a first distance, X, from the end 18 that is from about 2% to about 35%. Desirably, the fin 22 is positioned a first distance of from about 5% to about 20% from the end 18, and more preferably the fin 22 is positioned a first distance of from about 5% to about 10% from the end 18. The "first distance", as used for this measurement, is determined by measuring the overall length of the wakeboard 10 taken along the long or longitudinal axis of the board 10. The fin 22 is positioned in such a manner that the closest edge of the fin 22 is the percent times the overall length.

Each fin 22 is positioned inward from a side edge 28 a second distance, Y, of from about 3% to 45%. Preferably, each fin 22 is positioned inward from the side edge 28 of from about 5% to 35%, and more preferably is positioned inward from the side edge 28 from about 10% to 25%. The "second distance" as used for this measurement, is determined by measuring the overall width of the wakeboard 10 taken along the short or transverse axis of the board 10. The fin 22 is positioned inward from the side edge 28 such that the closest edge of the fin 22 is the percent times the overall width.

The wakeboard 10 includes a plurality of relatively narrow, compared to the width and length of the wakeboard, longitudinal through channels or slots 30, one through slot accommodating each fin 22. Since each slot or channel 30 is substantially identical, only one will be hereinafter described, unless otherwise noted. The slot 30 is a through channel, i.e., extends from the bottom surface 16 through to the upper surface 14, that partially surrounds the fin 22 and is of sufficient width and length so that a fin 22 can lift or cam upwardly when contacting a hard surface allowing the lower edge 26 to withdraw even with the bottom surface 16, if necessary. However, the slot 30 is not grossly overly sized so as to interfere with the operation of the wakeboard 10 during use. Generally, the slot 30 is from 0.05 to 0.5 of an inch (0.13 centimeters to 1.3 centimeters) wider and longer than the fin 22. However, the slot 30 may be wider and longer depending upon the length and width of the fin 22 partially residing within the slot 30. As noted above, the slot 30 is appropriately dimensioned to allow for free movement of the fin 22 within the slot 30.

The wakeboard 10 further includes a biasing means comprising a biasing member 34 that is attached, either permanently or removably, to each fin 22 in a fin pair using a rigid attachment means 35. The biasing member 34 has a first portion 36 affixed to the top 24 of each fin 22 in the fin pair and a second portion 38 rigidly affixed, either permanently or removably, to the upper surface 14 of the wakeboard 10. The biasing member 34 can be inlaid into the upper surface 14 so that the top is flush with the upper surface 14, or lay on top of the upper surface 14 as is illustrated. The biasing means applies a general downward force on each fin 22 in the pair. Advantageously, this embodiment allows each fin 22 to retract independently, resist damage as the fin 22 strikes an object, and remain affixed to the wakeboard 10.

The biasing member 34 can be constructed from any flexible and resilient material that can be vertically deflected at an angle of up to about 5° from the horizontal, preferably up to 25° and more preferably up to about 35°, and most preferably can be vertically deflected greater than 45° from the horizontal and substantially return to the original, pre-stressed state with less than about 5° permanent vertical deformation and having less than about 20% downward biasing force reduction.

Deflection and force reduction are determined by using a member having a width of 3 inches (7.6 centimeters) rigidly affixed to a stationary surface. A measuring force is applied normal to the member surface at a distance of 18 inches (46 centimeters) from the fixation point and the member vertically deflected to an angle of 15° and held constant for a period of 5 seconds. The force is then released from the member over a 5 second interval and the member is allowed to remain at rest for 5 minutes. This is repeated 3 more times. Vertical deformation is then measured at the end of the last 5 minute resting period. The loss of downward biasing force is determined by the difference in the amount of force used to achieve the first defection and the last deflection, divided by the amount of force used to achieve the first defection.

Examples of suitable materials that may be utilized as a biasing member 34 include, but are not limited to, resilient metals such as spring steel; wood; thermoformable polymers and moldable polymers, such as various acrylic and acrylic acid polymers, polycarbonate, polyesters, such as PET and PBT; glass and carbon fiber reinforced polymers and resins; laminated constructions and mixtures thereof. These materials are well known and commercially available. It is evident from the materials that can be utilized in constructing the biasing member 34 that the thickness and width of the member 34 can be from about 0.005 to about 0.75 of an inch thick and be from 0.25 to about 8 inches in width with a design criteria being that each fin 22 in the fin pair be able to be rigidly affixed to the first portion 36 of the resilient biasing member 34.

Figure 3A:
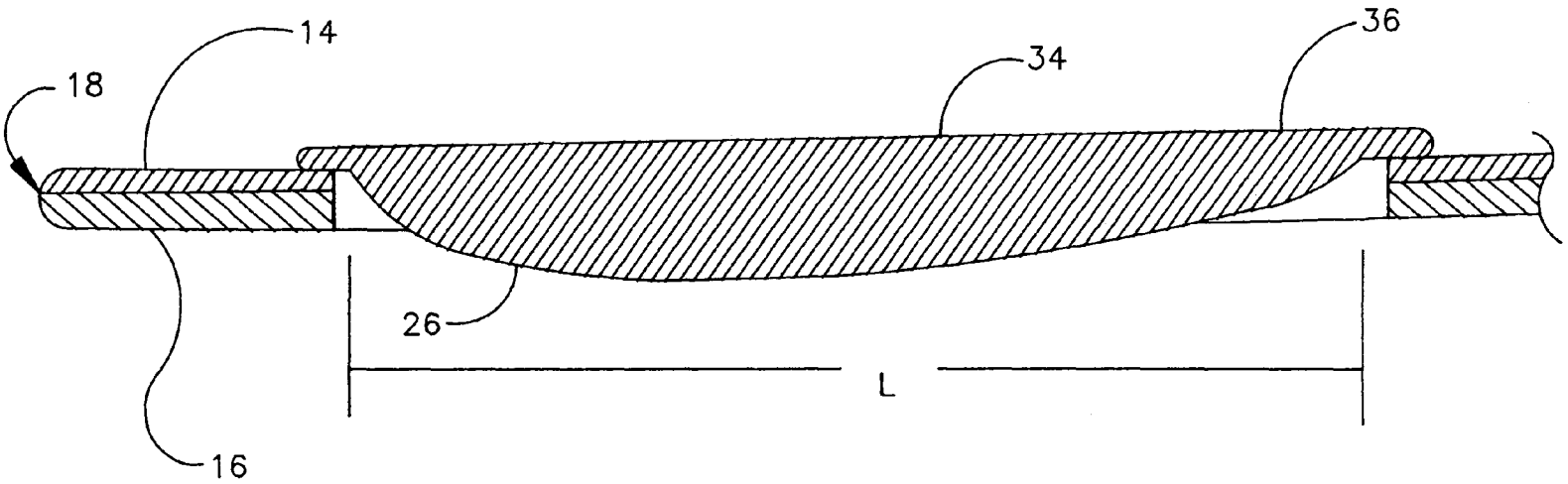
FIG. 3A is an enlarged cross-sectional view taken along line 3-3 of FIG. 1 illustrating the biasing means and fin as a single member.
Figure 3B:
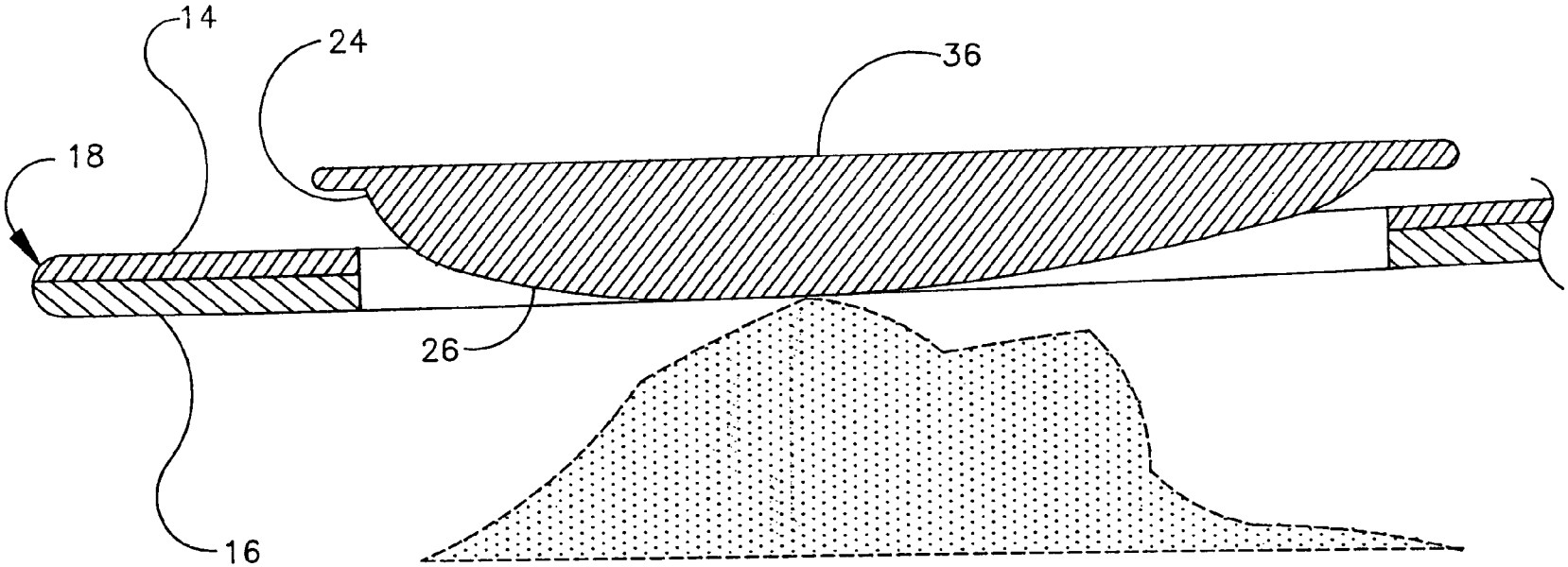
FIG. 3B is an enlarged cross-sectional view taken along line 3-3 of FIG. 1 illustrating the biasing means and the fin in a raised position as it rides over an underwater object (shown in phantom and not part of the present invention).

Referring to FIGS. 3A and 3B, in one embodiment the fin pair 22 and the biasing member 34 are constructed from thermoformable polymers; moldable polymers; glass or carbon fiber reinforced polymers and resins; laminated structures; and combinations thereof so that the fin pair 22 and the biasing member 34 may be constructed as an integrated single member, i.e., a one piece design. In this embodiment, the top of the fin 24 and the first portion 36 of the biasing member 34 would be distinguishable as the fin 22 resides at least partially within the channel or slot 30.

Figure 4:
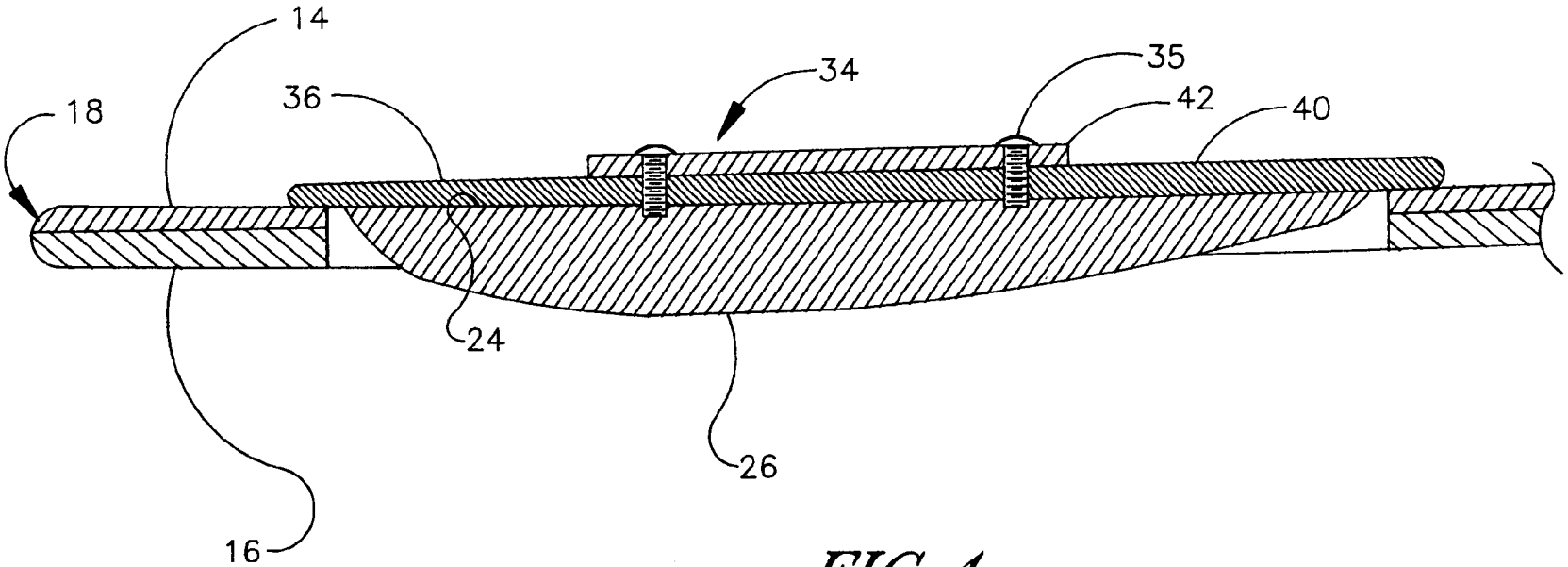
FIG. 4 is a cross-sectional view taken along line 3-3 of FIG. 1 illustrating the fin and biasing means as individual components, the biasing means having two members which are rigidly affixed to the fin using attachment means.

Referring to FIG. 4, in another embodiment, the biasing member 34 and each fin 22 are constructed as individual pieces or members so that each fin 22 is removably or permanently attached to the biasing member 34 using a means for rigid attachment 35, such as welding, rivets, screws, bolts, or combinations thereof. It is further contemplated in this embodiment that the biasing member 34 comprises a plurality of layers 40 and 42 and each layer 40 and 42, is removably or permanently attached to the fin 22 using a means for rigid attachment 35 such as welding, rivets, screws, bolts, or combinations thereof.

Figure 5:
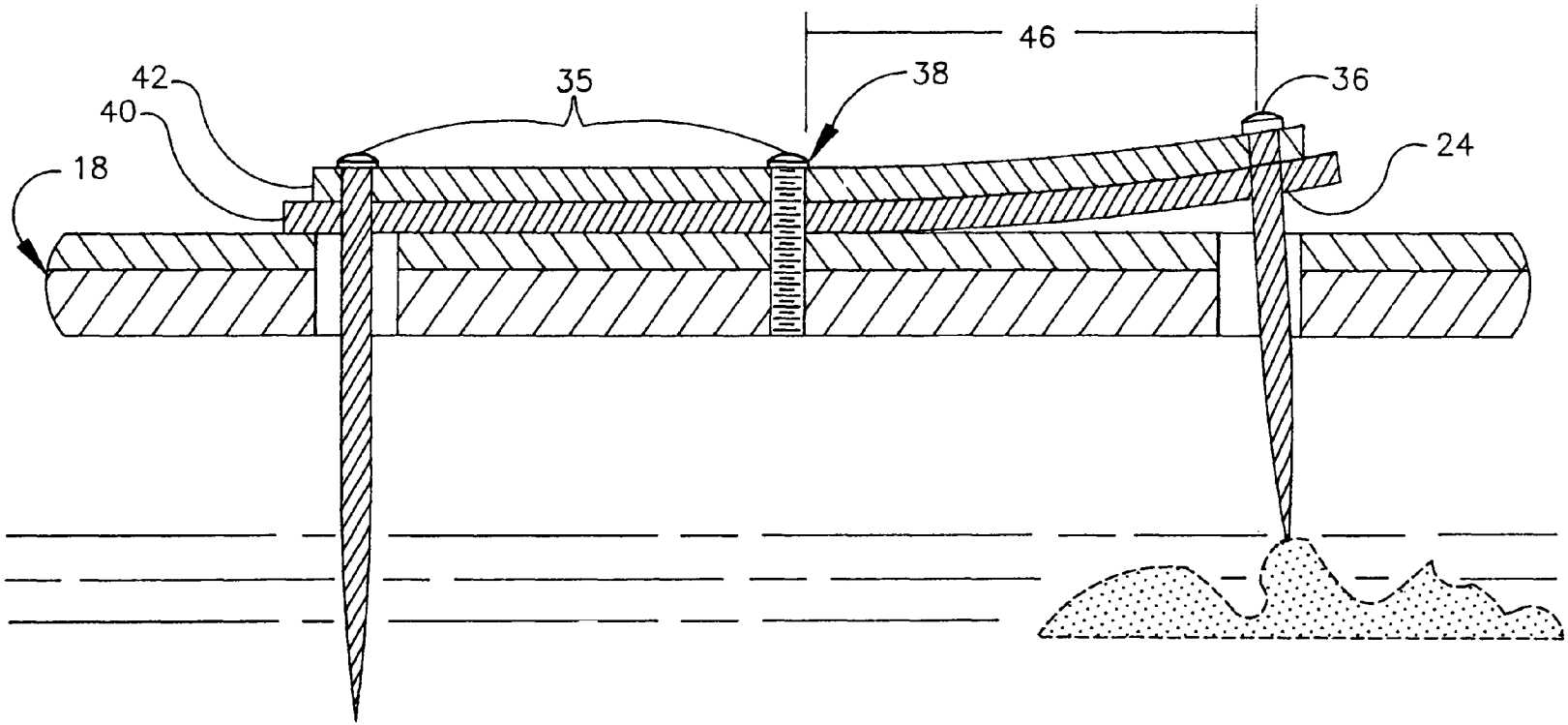
FIG. 5 is a cross-sectional view taken along line 5-5 of FIG. 1 illustrating the attribute of how each fin independently retracts in a raised position as it rides over an underwater object (shown in phantom and not part of the present invention).

Referring to FIG. 5, in yet another embodiment, the biasing member 34 comprises a plurality of layers 40 and 42 wherein one of the layers, preferably layer 40 as it resides adjacent to the upper surface 14, is constructed as a one piece design having the fin pair 22 incorporated into the layer. The second layer, illustrated as 42, is provided for added rigidity and/or resiliency, and is removably or permanently attached to the fin 22 using a means for rigid attachment 35 such as welding, rivets, screws, bolts, or combinations thereof.

In any of the aforementioned embodiments, the biasing member 34 is attached to the upper surface 14 at the second portion 38, either removably or permanently, using known attachment techniques or means 35, such as, for example, welding, adhesive, rivets, nails, screws, bolts, combinations thereof. The biasing member 34 is attached to the wakeboard 10 at the second portion 38 which desirably is substantially along the longitudinal central axis of the wakeboard 10. This provides and defines substantially equal length fulcrum arms 46 that downwardly bias each fin 22 in the fin pair with a substantially equal amount of force. Advantageously, the fulcrum arms 46 permit each fin 22 to independently act and respond to objects in the water and allow substantial isolation for the other fin 22 in the pair. As used herein, the term "substantially" means having less than about 30% difference, preferably less than about 20% difference and more preferably less than about 8% difference.

The biasing member 34 can have a geometric configuration that varies from straight edges, such as a rectangle, to a modified hour-glass shape. Desirably, the biasing member 34 has a configuration that covers the top ends of each fin 22 so that when the fin 22 is raised above the plane of the upper surface 14 the top ends would not expose sharp edges.

As noted above, the lower edge 26 of the fin desirably has a sloping or a curved configuration, although it may be formed instead with a straight line edge or any other shape as may be desired. The function of the edge 26 is to present a smooth lower camming surface, which when the fin 22 contacts an object in the water, such as a ramp, rock, sandbar or other object, will cause the fin 22 to immediately rise upwardly through slot 30 and against the downward force of the fulcrum arm 42 of the bias means 32. As the fin 22 passes over the object the fin 22 is returned to the normal operating position again by the downward force of the fulcrum arm 46.

An advantage of the present invention is that when an extreme flexing action of the wakeboard 10 occurs, such as when engaging a ramp, jumping a wave or when encountering a submerged object, the manner by which the fins 22 and the biasing member 34 are constructed and attached to the board, minimize any structural deficiency of these parts by providing a more or less flexible connection for the fin 22 and biasing member 34 to the wakeboard 10. This prevents damage to the fin 22 and/or wakeboard 10 and provides the user with a more stable and enjoyable ride.

Having described the invention in detail, those skilled in the art will appreciate that modifications may be made to the various aspects of the invention without departing from the scope and spirit of the invention disclosed and described herein. It is, therefore, not intended that the scope of the invention be limited to the specific embodiments illustrated and described but rather it is intended that the scope of the present invention be determined by the appended claims and their equivalents. Moreover, all patents, patent applications, publications, and literature references presented herein are incorporated by reference in their entirety for any disclosure pertinent to the practice of this invention.

What is claimed is:

1. In a water sporting flotation device having an upper surface directed toward a user, a bottom surface directed toward the water, and a pair of stabilizing fins, each fin having a top portion and a bottom edge wherein the improvement comprises:

a) a plurality of longitudinally disposed through slots, each slot partially surrounding each fin; and b) a resilient biasing means comprising a biasing member having a first end portion and a second end portion, each end portion attached to the respective top portion of said each fin and a central portion affixed to said upper surface of said water sporting flotation device substantially along a longitudinal central axis so as to form substantially equal length fulcrum arms, wherein said biasing means can deflect sufficiently above the upper surface and allow the bottom edge of said each fin to retract parallel to the bottom surface of the flotation device.

2. The water sport floatation device of claim 1 wherein said device is a wakeboard.

3. The water sport floatation device of claim 2 wherein said wakeboard has an end and each of said fins is positioned on the board a first distance from said end that is from about 2% to about 35%.

4. The water sport floatation device of claim 3 wherein said first distance is from about 5% to about 20%.

5. The water sport floatation device of claim 3 wherein said first distance is from about 5% to about 10%.

6. The water sport floatation device of claim 2 wherein said wakeboard has a side edge and each of said fins is positioned on the board a second distance from said side edge that is from about 3% to about 45%.

7. The water sport floatation device of claim 6 wherein said second distance is from about 5% to about 35%.

8. The water sport floatation device of claim 1 wherein said each slot is from 0.05 to 0.5 of an inch wider and longer than said each fin.

9. The water sport floatation device of claim 1 wherein said biasing member has a modified hour-glass configuration that covers ends of each fin.

10. The water sport floatation device of claim 1 wherein said biasing member and each fin are constructed as individual members.

11. The water sport floatation device of claim 1 wherein said biasing member comprises a plurality of layers.

12. The water sport floatation device of claim 1 wherein said pair of stabilizing fins and said biasing member are constructed as a one piece design.

13. A wake board for water sports comprising:

a) an upper surface directed toward a user;

b) an opposing a bottom surface directed toward the water;

c) a pair of stabilizing fins, each fin having a top portion, a bottom edge and front and rear ends;

d) through slots in said upper surface and said bottom surface so that each slot at least partially surrounds a respective each fin and allows each fin to extend below the bottom surface; and e) a biasing member having a first end portion and a second end portion, each end portion rigidly attached to the respective top portion of said each fin and a central portion rigidly attached to the upper surface so as to form substantially equal length fulcrum arms, said fulcrum arms applying a substantially equal general downward force on each fin in a manner that allows said bottom edge of said each fin to retract at least parallel to the bottom surface whenever said each fin contacts a submerged or floating object.

14. The wake board of claim 13 wherein each slot is from 0.05 to 0.5 of an inch wider and longer than said fin.

15. The wake board of claim 13 wherein said biasing member and each fin are constructed as individual members and said biasing member has a modified hour-glass configuration that covers the ends of each fin.

16. The wake board of claim 13 wherein said biasing member comprises a plurality of layers.

17. The wake board of claim 13 wherein said pair of stabilizing fins and said biasing member are constructed as a one piece design.

* * * * *